US006604305B2

(12) United States Patent
Koch

(10) Patent No.: US 6,604,305 B2
(45) Date of Patent: Aug. 12, 2003

(54) METHOD AND APPARATUS FOR CONTROLLING AN EXTENDABLE STICK ON A WORK MACHINE

(75) Inventor: Roger D. Koch, Pekin, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/966,617

(22) Filed: Sep. 28, 2001

(65) Prior Publication Data

US 2003/0061742 A1 Apr. 3, 2003

(51) Int. Cl.[7] ..... E02F 5/02

(52) U.S. Cl. ..... 37/348; 37/195; 701/50; 414/800

(58) Field of Search ..... 414/800, 730, 414/732, 733, 738, 728; 483/1, 13, 14, 901, 902; 901/1, 8, 9, 14, 30, 31, 33, 32, 37, 39, 46, 50; 37/348, 395, 396, 397, 414, 195, 466; 701/50

(56) References Cited

U.S. PATENT DOCUMENTS 3,624,785 A 11/1971 Wilson
3,661,276 A * 5/1972 Wiesener ..... 214/1 CM
3,757,066 A * 9/1973 Sterner et al. ..... 200/82 R
3,871,538 A 3/1975 Miller et al.
4,132,937 A * 1/1979 Engelberger et al. ..... 318/568
4,274,797 A 6/1981 Coon
5,154,561 A * 10/1992 Lee ..... 414/138.3
5,267,824 A 12/1993 Kishi
5,638,616 A 6/1997 Kishi
5,953,838 A 9/1999 Steenwyk
6,325,749 B1 * 12/2001 Inokuchi et al. ..... 483/13
2001/0055525 A1 * 12/2001 Inokuchi et al. ..... 414/800

* cited by examiner

*Primary Examiner*—Christopher J. Novosad
(74) *Attorney, Agent, or Firm*—Steve D Lundquist

(57) ABSTRACT

A method and apparatus for automatically controlling the movement of an extendable stick on a work machine. The extendable stick is slidably connected to a stick, and the stick is pivotally connected to a boom. The method and apparatus includes determining a position of the stick relative to the boom, determining a position of the extendable stick relative to the stick, receiving a stick movement command to move the stick relative to the boom, moving the stick relative to the boom, and moving the extendable stick in coordination with the movement of the stick as a function of a desired position of the extendable stick relative to the position of the stick.

26 Claims, 9 Drawing Sheets

METHOD AND APPARATUS FOR CONTROLLING AN EXTENDABLE STICK ON A WORK MACHINE

TECHNICAL FIELD

This invention relates generally to a method and apparatus for controlling the movement of an extendable stick on a work machine and, more particularly, to a method and apparatus for coordinating the movement of an extendable stick with the movement of a stick on the work machine.

BACKGROUND

Work machines having multiple linkages with multiple degrees of movement are commonly used for various tasks. For example, in earthworking applications, work machines such as backhoe loaders, excavators and shovels have multiple linkages which are used to controllably move a work implement, such as a bucket, scraper, hammer, hoist and the like.

A backhoe loader, for example, typically includes a boom, a stick pivotally attached to the boom, and a work implement such as a bucket pivotally attached to the stick. An operator of such a machine controls the movements of the boom, stick and bucket in coordination with each other to controllably perform a work task, such as digging, trenching or dredging. Usually the operator controls the movement of these linkages by the use of control levers, one for each linkage. A skilled operator can usually coordinate all of the control levers in a manner which efficiently controls the work implement as though all of the linkages operated as one unit.

There are situations in which the linkages do not provide the reach needed to perform certain tasks. For example, if it is desired to dig very deep, or to extend the work implement a great distance from the work machine, the physical constraints of the linkage components may not suffice for the work needed. Consequently, one solution has been to develop a stick linkage that extends; that is, an extendable stick. Extendable sticks are known for use with backhoe loaders, excavators, and other types of machines. Although an extendable stick provides a greater reach for the work implement, an additional control lever is required, thus making a complex and difficult control task even more difficult, even for a skilled operator. It is desired, therefore, to provide the greater reach capabilities of a work machine having an extendable stick, yet avoid the additional complexity involved with control of the work implement.

The present invention is directed to overcoming one or more of the problems as set forth above.

SUMMARY OF THE INVENTION

In one aspect of the present invention a method for automatically controlling the movement of an extendable stick on a work machine is disclosed. The extendable stick is slidably connected to a stick, and the stick is pivotally connected to a boom The method includes the steps of determining a position of the stick relative to the boom, determining a position of the extendable stick relative to the stick, receiving a stick movement command to move the stick relative to the boom, moving the stick relative to the boom, and moving the extendable stick in coordination with the movement of the stick as a function of a desired position of the extendable stick relative to the position of the stick.

In another aspect of the present invention an apparatus for automatically controlling the movement of an extendable stick on a work machine is disclosed. The extendable stick is slidably connected to a stick, and the stick is pivotally connected to a boom. The apparatus includes means for determining a position of the stick relative to the boom, means for determining a position of the extendable stick relative to the stick, means for receiving a stick movement command to move the stick relative to the boom, means for moving the stick relative to the boom, and means for moving the extendable stick in coordination with the movement of the stick as a function of a desired position of the extendable stick relative to the position of the stick.

In yet another aspect of the present invention an apparatus for automatically controlling the movement of an extendable stick on a work machine is disclosed. The extendable stick is slidably connected to a stick, and the stick is pivotally connected to a boom. The apparatus includes a first sensor for determining a position of the stick relative to the boom, a second sensor for determining a position of the extendable stick relative to the stick, and a controller for receiving a stick movement command to move the stick relative to the boom, for moving the stick, and for moving the extendable stick in coordination with the movement of the stick as a function of a desired position of the extendable stick relative to the position of the stick.

In yet another aspect of the present invention a method for controlling the movement of an extendable stick on a work machine is disclosed. The extendable stick is connected to a stick, and the stick is pivotally connected to a boom. The method includes the steps of selecting one of a manual control mode and a coordinated control mode, operating each of a stick control device and an extendable stick control device to control the respective movement of each of the stick and the extendable stick in response to selecting the manual control mode, and operating only the stick control device to control the movement of the stick and the extendable stick in response to selecting the coordinated control mode, the movement of the extendable stick being made in coordination with the movement of the stick as a function of a desired position of the extendable stick relative to the position of the stick.

In yet another aspect of the present invention a work machine is disclosed. The work machine includes a boom, a stick having a first end pivotally connected to the boom, an extendable stick having a first end slidably connected to a second end of the stick, a work implement controllably attached to a second end of the extendable stick, a first sensor for determining a position of the stick relative to the boom, a second sensor for determining a position of the extendable stick relative to the stick, a stick control device for delivering a stick movement command, and a controller for receiving the stick movement command and responsively moving the stick relative to the boom, and for moving the extendable stick in coordination with the movement of the stick as a function of a desired position of the extendable stick relative to the position of the stick.

DETAILED DESCRIPTION

Figure 1:
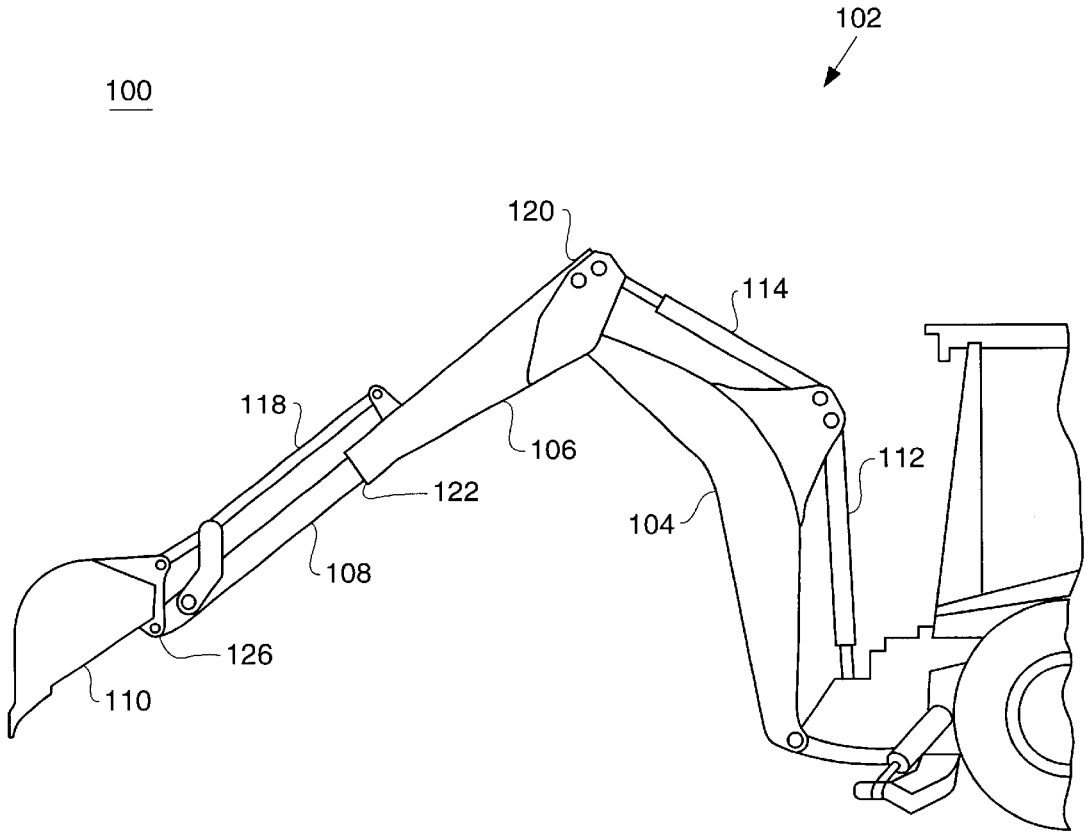
FIG. 1 is a diagrammatic illustration of a portion of a work machine suited for use with the present invention.

With reference to the drawings and the appended claims, a method and apparatus 100 for automatically controlling the movement of an extendable stick 108 on a work machine 102 is shown. In the preferred embodiment, the extendable stick 108 is slidably connected to a stick 106, and the stick 106 is pivotally connected to a boom 104.

Figure 1A:
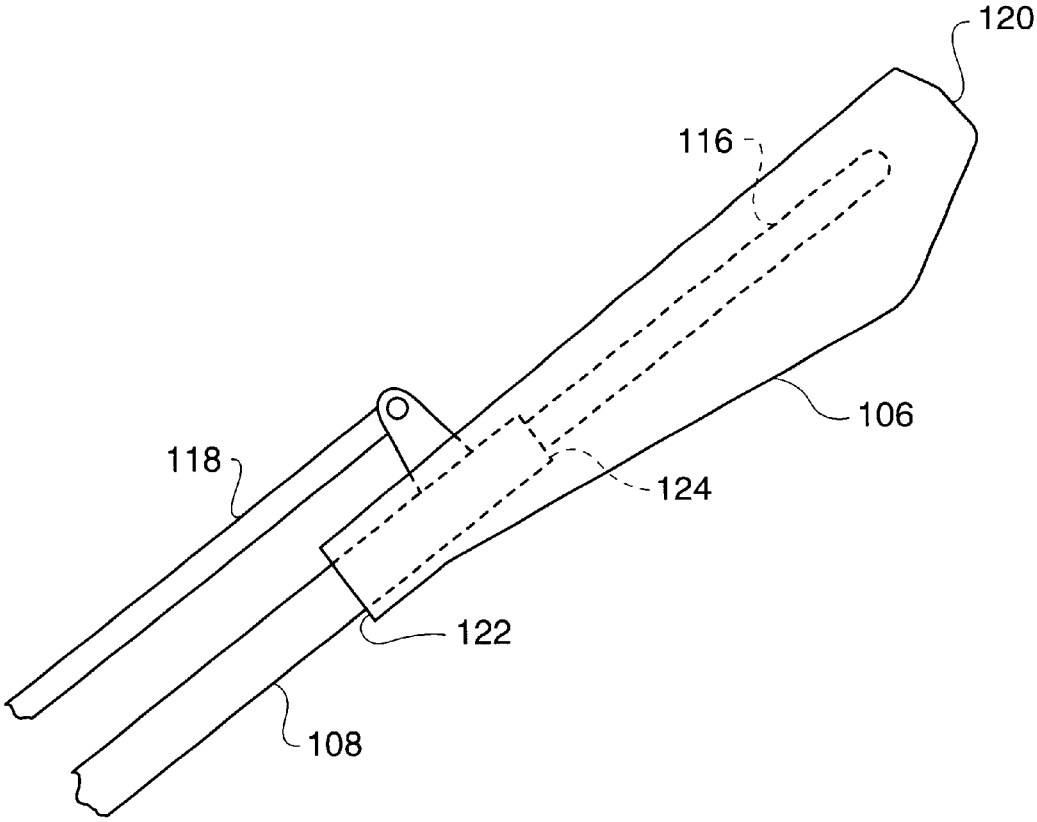
FIG. 1*a* is a diagrammatic illustration of an enlarged portion of the work machine of FIG. 1.

Referring in particular to FIGS. 1 and 1*a*, a work machine 102 is shown in relevant portion as a backhoe loader, typically used for a wide variety of earthworking and construction applications. The work machine 102 includes a work implement 110 controllably attached to the work machine 102 by means of multiple linkages, e.g., the boom 104, stick 106, and extendable stick 108. The multitude of linkages allows the work implement 110 to be controlled over a large area in a versatile manner. For example, extension of the work implement 110 away from the work machine 102 is increased by having multiple linkages.

Although the work machine 102 is shown as a backhoe loader, it is noted that other types of work machines 102 having multiple linkages, e.g., excavators, front shovels, and the like, may benefit from the present invention. Furthermore, although the work implement 110 is shown as a bucket, other types of work implements 110, such as scrapers, drills, hammers, claws, and the like, may be used as well with the present invention.

Typically, a work machine 102, such as the backhoe loader shown, includes only a boom 104, a stick 106, and a work implement 110. However, there are situations in which it is desired or required to enable a greater reach of the work implement 110. For example, it may be required to dig or trench to a deeper level than possible with the conventional boom 104, stick, 106, and work implement 110 arrangement. In situations such as these, one solution is to add an extendable stick 108 to the stick 106 to extend the reach of the work implement 110. The present invention is designed for a work machine 102 having an extendable stick 108 as part of the linkage arrangement.

The boom 104 is pivotally controlled about the work machine 102 by a boom cylinder 112. The stick 106 is pivotally controlled about the boom 104 by a stick cylinder 114. A first end 120 of the stick 106 is connected at a pivot point to the boom 104. The extendable stick 108 is slidably controlled with respect to the stick 106 by an extendable stick cylinder 116. More specifically, the extendable stick 108 has a first end 124 which is slidably connected to a second end 122 of the stick 106. As FIG. 1*a* shows, the extendable stick 108 and the extendable stick cylinder 116 are contained within the stick 106 so that the extendable stick 108 controllably slides, i.e., extends and retracts, relative to the stick 106. The work implement 110 is pivotally connected to a second end 126 of the extendable stick 108 and is controllably pivoted by a work implement cylinder 118. It is noted that, as FIG. 1*a* shows, the work implement 110, and the work implement cylinder 118 are connected to the extendable stick 108 so that the work implement 110 and the work implement cylinder 118 are fixed in position relative to the extendable stick 108; that is, the work implement 110 and the work implement cylinder 118 extend and retract relative to the stick 106 as the extendable stick 108 extends and retracts.

Figure 7:
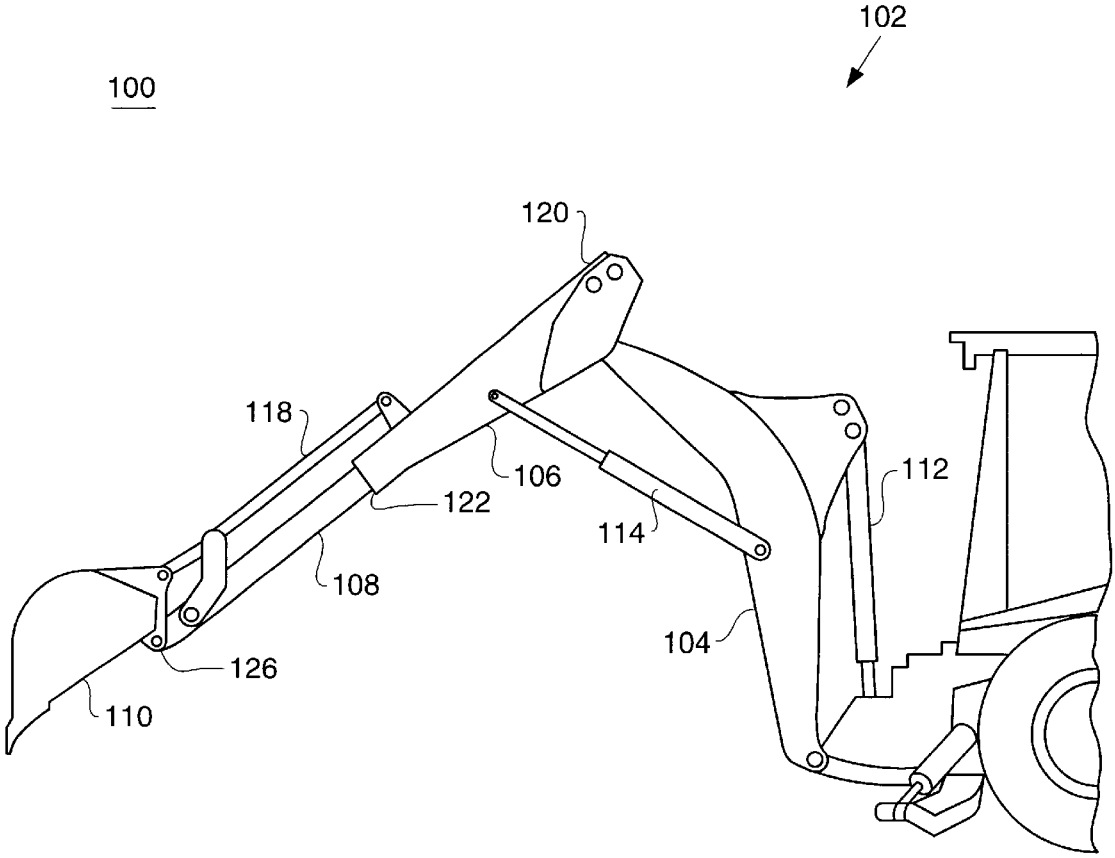
FIG. 7 is a diagrammatic illustration of an alternate version of a portion of a work machine suited for use with the present invention.

The configuration shown in FIGS. 1 and 1*a* are representative of a typical multiple linkage work implement 110 having an extendable stick 108. Variations in design and configuration are also embodied by the present invention, the illustrated design being exemplary only. For example, FIG. 7 illustrates a configuration in which the stick cylinder 114 is attached to the boom 104 and stick 106 such that as the stick cylinder 114 extends, the stick 106 extends relative to the boom 104. For purposes of explanation, operation of the present invention is described with reference to the linkage configuration shown in FIG. 1, unless otherwise indicated.

Figure 2:
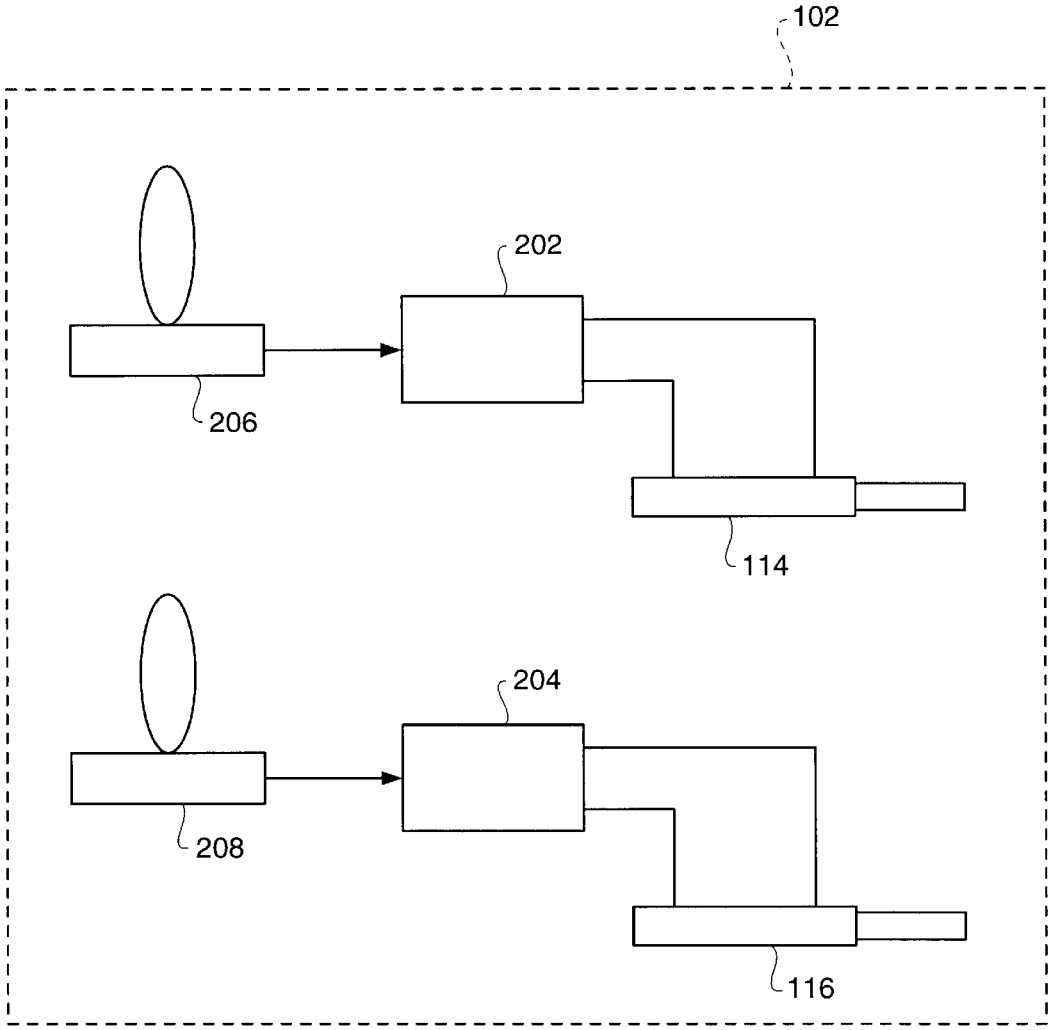
FIG. 2 is a block diagram illustrating manual control of a stick and an extendable stick.
Figure 3:
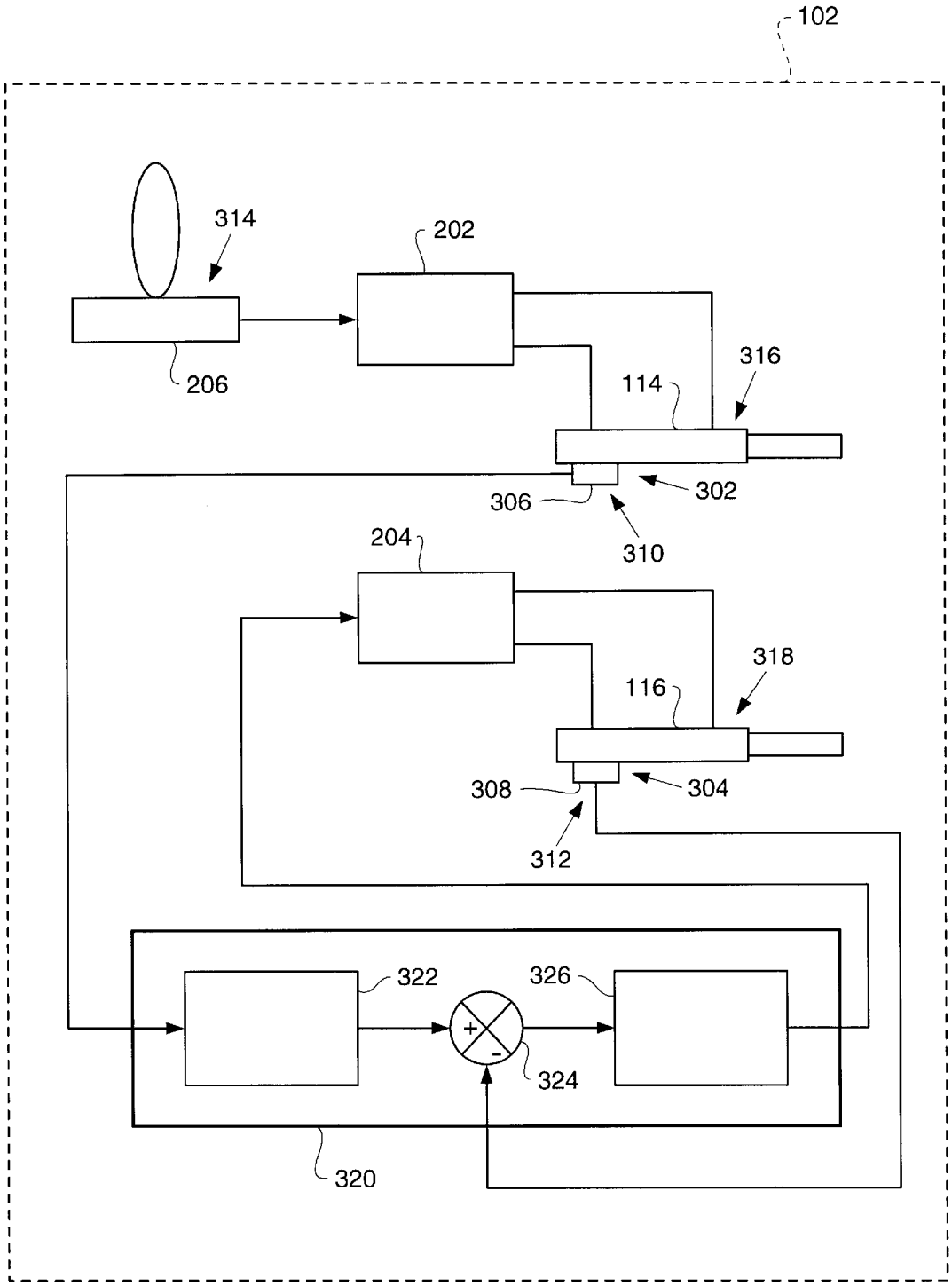
FIG. 3 is a block diagram illustrating coordinated control of a stick and an extendable stick.

Referring to FIGS. 2 and 3, block diagrams illustrating preferred embodiments of the present invention are shown. FIG. 2 shows a preferred embodiment of a manual control mode and FIG. 3 shows a preferred embodiment of a coordinated control mode. Preferably, an operator of the work machine 102 may select one of the above modes during operation.

Referring to FIG. 2, the stick cylinder 114 is controllably activated by a stick valve 202 in a manner well known in the art of electro-hydraulics. The stick valve 202 receives control information from a stick control device 206, such as a joystick or lever. Similarly, the extendable stick cylinder 116 is controllably activated by an extendable stick valve 204. The extendable stick valve 204 receives control information from an extendable stick control device 208, such as a joystick or lever. It is noted that in the manual control mode an operator must simultaneously operate both the stick control device 206 and the extendable stick control device 208, in addition to any other required control devices (not shown), such as control devices for the boom 104 and the work implement 110.

Referring to FIG. 3, in the coordinated control mode, control of both the stick 106 and the extendable stick 108 is provided by the stick control device only, as described in more detail below. Thus, an operator only needs to operate the stick control device 206, rather than both the stick control device 206 and the extendable stick control device 208, as required in the manual control mode.

A means 302 for determining a position of the stick 106 relative to the boom 104 is used to determine the angle of rotation of the stick 106 as compared to the position of the boom 104. In one embodiment, the means 302 for determining a position of the stick 106 includes a means 310 for determining a displacement of the stick cylinder 114, such as a first sensor 306. For example, the first sensor 306 may be any of a variety of sensors suited to determine displacement of a cylinder, such as RF sensors, laser position sensors, linear potentiometers, strain gauges, and the like. Alternatively, the first sensor 306 may be designed to determine the position of the stick 106 directly, such as a resolver. Hereinafter, reference is made to the first sensor 306 as being any embodiment described above for ultimately determining the position of the stick 106 relative to the boom 104.

A means 304 for determining a position of the extendable stick 108 relative to the stick 106 is used to determine an amount of extension of the extendable stick 108 from the stick 106. In one embodiment, the means 304 for determining a position of the extendable stick 108 includes a means 312 for determining a displacement of the extendable stick cylinder 116, such as a second sensor 308. For example, the second sensor 308 may be any of a variety of sensors suited to determine displacement of a cylinder, such as RF sensors, laser position sensors, linear potentiometers, strain gauges, and the like. Alternatively, the second sensor 308 may be designed to determine the position of the extendable stick directly, such as a linear potentiometer. Hereinafter, reference is made to the second sensor 308 as being any embodiment described above for ultimately determining the position of the extendable stick 108 relative to the stick 106.

A means 314 for receiving a stick movement command to move the stick 106 relative to the boom 104, preferably the stick control device 206, is adapted to receive commands from an operator of the work machine 102, and responsively generate a signal corresponding to the stick movement command. In an alternate embodiment, the means 314 for receiving a stick movement command includes a set of preprogrammed commands, such as used in autonomous or semi-autonomous operation.

In the coordinated control mode, a means 316 for moving the stick 106 and a means 318 for moving the extendable stick 108 are controlled in coordination with each other so that movement of the stick 106 and movement of the extendable stick 108 is performed in one uniform motion. Preferably, the means 316 for moving the stick 106 includes the stick cylinder 114, and the means 318 for moving the extendable stick 108 includes the extendable stick cylinder 116.

A controller 320 is adapted to receive information from the first and second sensors 306, 308 relative to the position of the respective stick 106 and extendable stick 108, and responsively control the movement of the extendable stick 108 in coordination with the movement of the stick 106. In the preferred embodiment, the controller 320 is a microprocessor-based controller, as is well known in the art.

Figure 4:
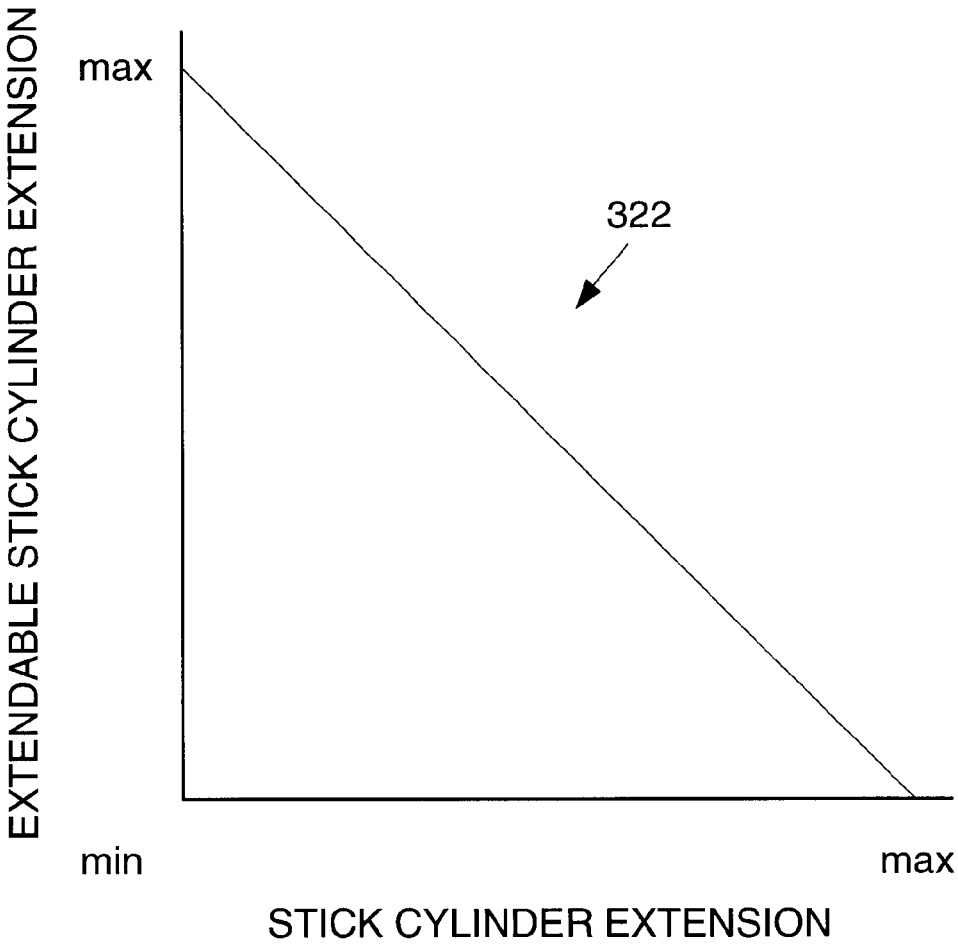
FIG. 4 is a map illustrating stick cylinder extension relative to extendable stick cylinder extension.
Figure 8:
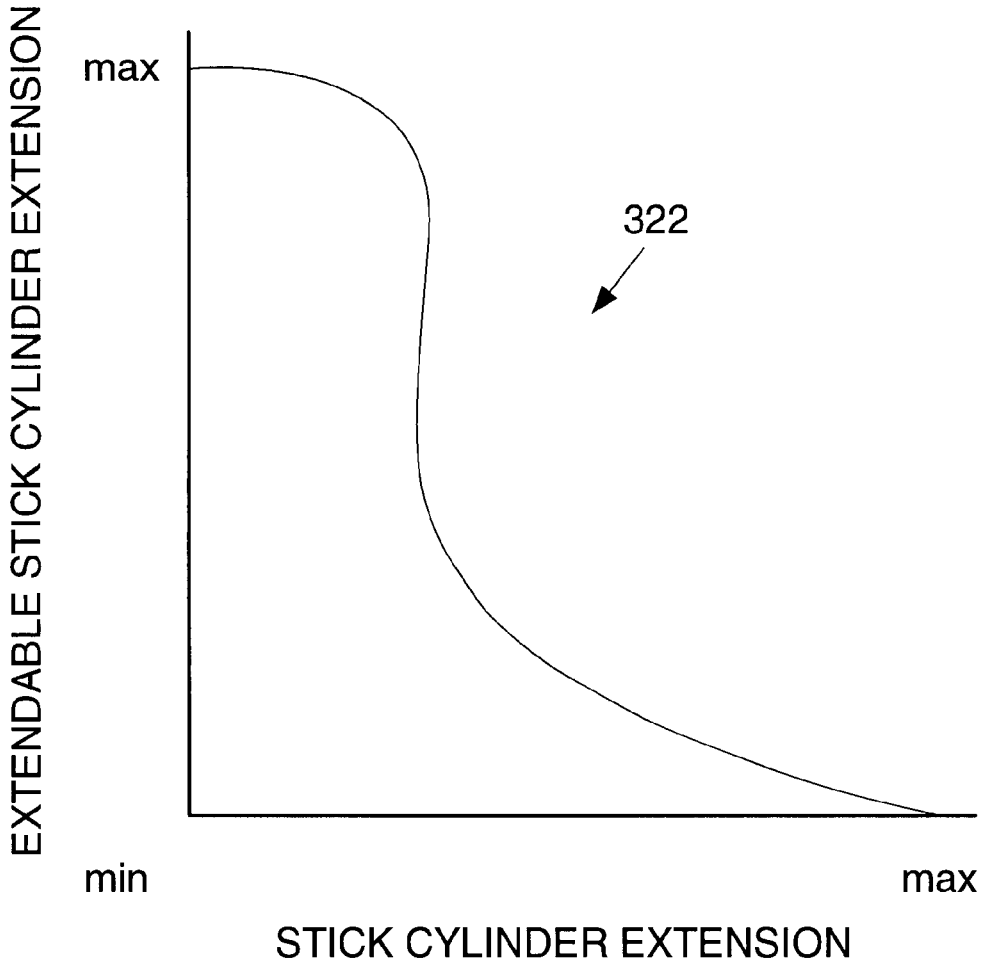
FIG. 8 is an alternate map illustrating stick cylinder extension relative to extendable stick cylinder extension.

In one embodiment, the controller 320 includes a map 322 of stick position as opposed to extendable stick position. More particularly, in the preferred embodiment, the map 322 is a map of the extension of the stick cylinder 114 vs. the extension of the extendable stick cylinder 116. An exemplary map is shown in FIG. 4. In this version of a map, the relationship between stick cylinder extension and extendable stick cylinder extension is linear. More particularly, as the stick cylinder extension increases, the extendable stick cylinder extension decreases in a linear manner. It is noted that other map configurations could just as well be used to obtain a desired coordinated behavior of the stick 106 and the extendable stick 108. For example, FIG. 8 depicts a map 322 in which a nonlinear relationship is shown between the stick cylinder extension and the extendable stick cylinder extension. A nonlinear curve may be used, for example, to obtain certain desired performance characteristics.

It is noted that, in the linkage configuration shown in FIG. 7, a map 322 would be used which includes a plot of increasing extendable stick cylinder extension with increasing stick cylinder extension. Thus, for example, the map 322 of FIG. 4 would show a positively sloped curve rather than the currently shown negatively sloped curve.

In another embodiment, the controller 320 includes an algorithm for determining stick position as opposed to extendable stick position. The algorithm can be designed to obtain certain desired performance characteristics. An exemplary algorithm is shown as:

$$X_{estickdesired} = \left[\frac{X_{estick\ max} - X_{estick\ min}}{X_{stick\ min} - X_{stick\ max}}\right](X_{stickactual} - X_{stick\ min}) + X_{estick\ max}$$

The output of the map 322 or algorithm, i.e., a desired extension of the extendable stick cylinder 116, is output to a summer 324 for comparison with an actual extension of the extendable stick cylinder 116, preferably determined by the second sensor 308. The difference between the desired and actual extensions is delivered to a closed loop control 326, and the position of the extendable stick cylinder 116 is controlled accordingly.

Figure 5:
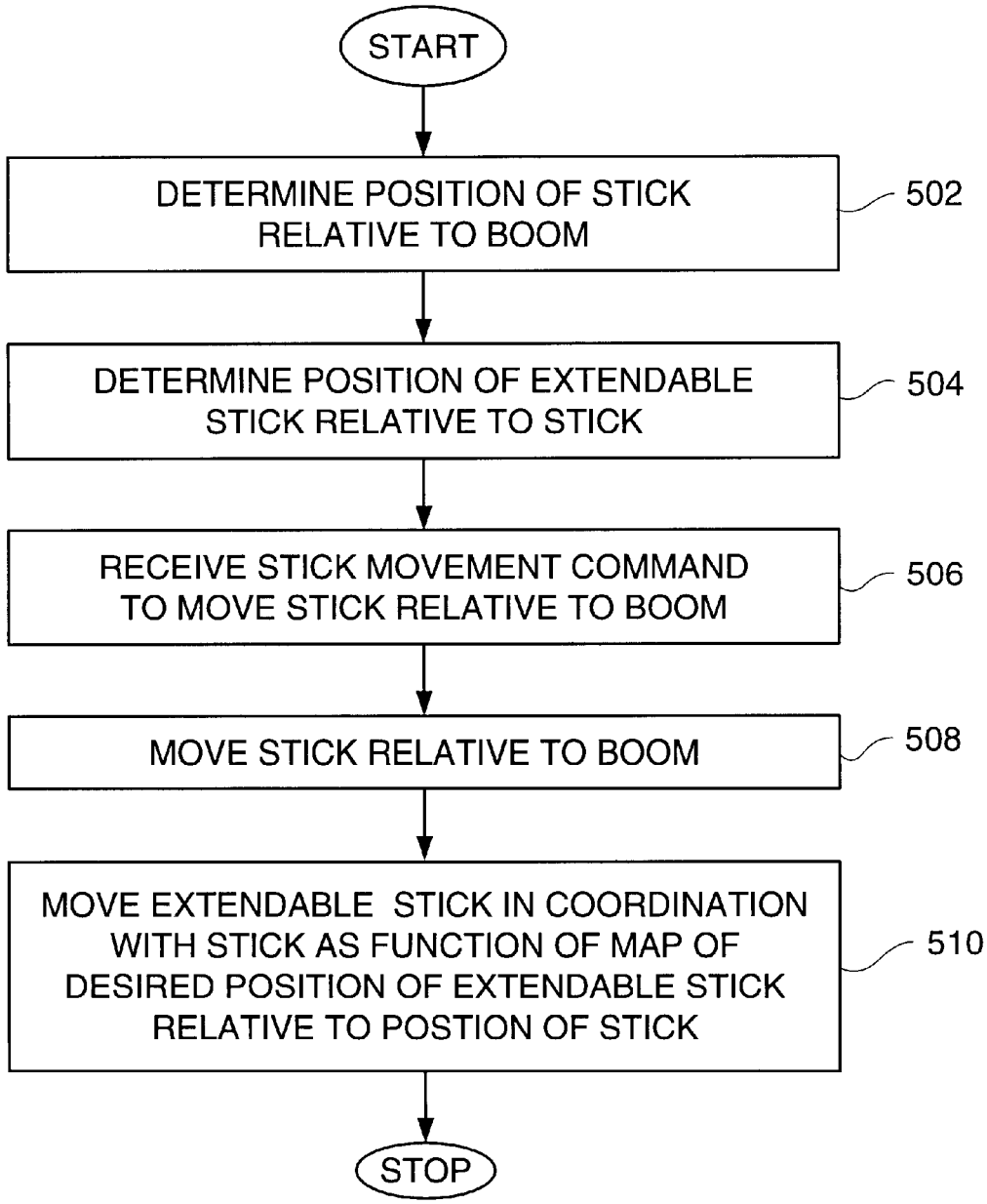
FIG. 5 is a flow diagram illustrating a first embodiment of the present invention.

Referring to FIG. 5, a flow diagram illustrating a first aspect of the present invention is shown.

In a first control block 502, the position of the stick 106 relative to the boom 104 is determined, preferably by the procedures described above.

In a second control block 504, the position of the extendable stick 108 relative to the stick 106 is determined.

In a third control block 506, a stick movement command is received from an operator of the work machine 102 to move the stick 106 relative to the boom 104. Preferably, the stick movement command is received by a stick control device 206, such as a lever.

In a fourth control block 508, the stick 106 is moved relative to the boom 104, i.e., by pivoting about the point of connected between the stick 106 and the boom 104.

In a fifth control block 510, the extendable stick 108 is moved in coordination with the stick 106 as a function of a map 322 of the desired position of the extendable stick 108 relative to the actual position of the stick 106. More specifically, the map 322 is preferably a map 322 of the desired extension of the extendable stick cylinder 116 relative to the actual extension of the stick cylinder 114. Alternatively, the extendable stick 108 is moved in coordination with the stick 106 as a function of an algorithm designed to determine the desired position of the extendable stick 108 relative to the actual position of the stick 106.

Figure 6:
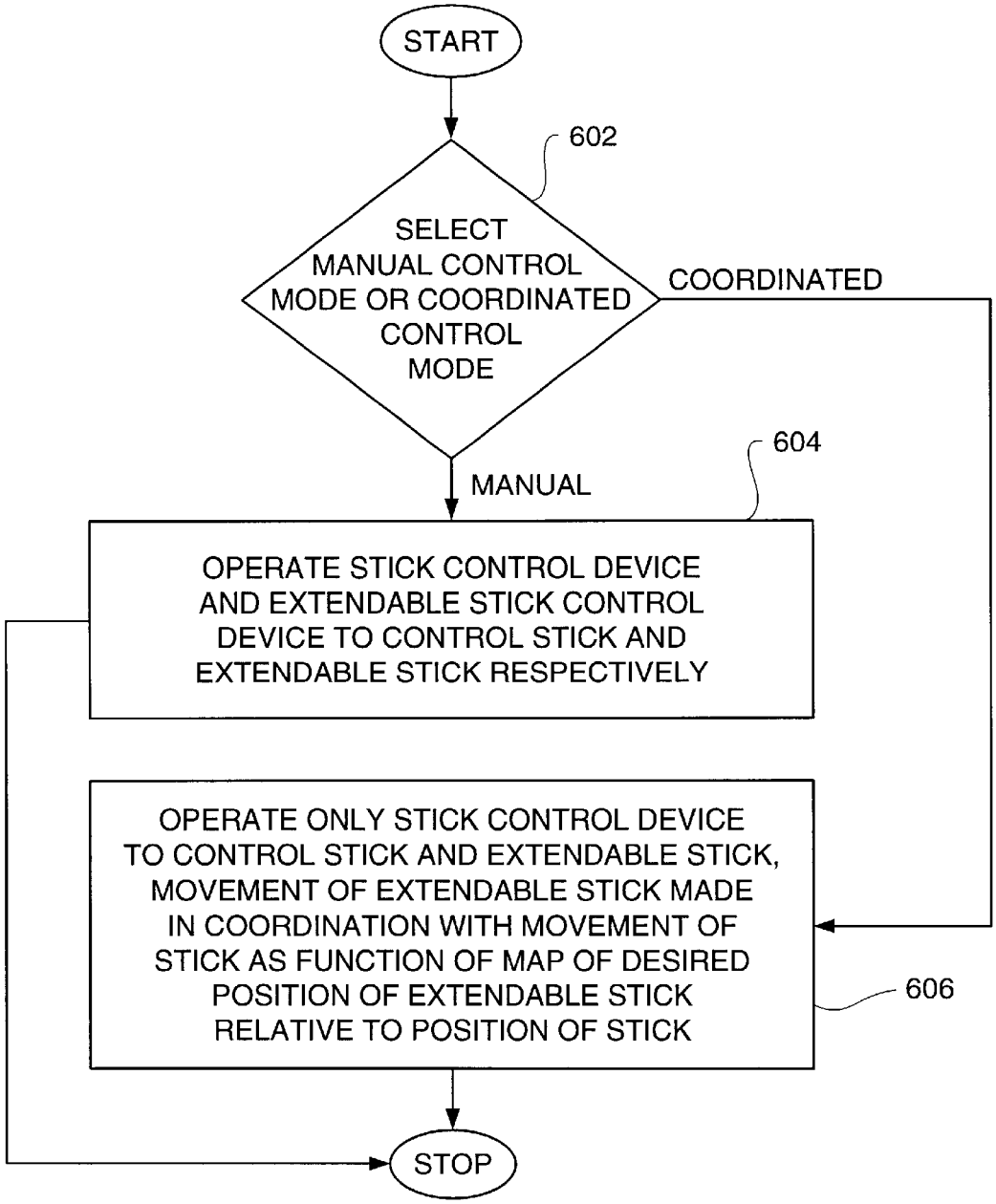
FIG. 6 is a flow diagram illustrating a second embodiment of the present invention.

Referring to FIG. 6, a flow diagram illustrating another aspect of the present invention is shown.

In a first decision block 602, either a manual control mode or a coordinated control mode is selected. In the preferred embodiment, if the operator of the work machine 102 chooses the manual control mode, the stick 106 and extendable stick 108 are controlled by two separate control devices, i.e., the stick control device 206 and the extendable stick control device 208, respectively, as a first control block 604 describes.

However, if the coordinated control mode is chosen, control proceeds to a second control block 606. Preferably, the operator operates only the stick control device 206 to control both the movement of the stick 106 and the movement of the extendable stick 108. The movement of the extendable stick 108 is made in coordination with the movement of the stick 106, preferably as a function of the map 322 of the desired position of the extendable stick 108 relative to the position of the stick 106, or alternatively as a function of an algorithm of the desired position of the extendable stick 108 relative to the position of the stick 106.

INDUSTRIAL APPLICABILITY

As an example of an application of the present invention, an operator of a work machine 102 such as an earthworking machine, e.g., a backhoe loader, must control several functions simultaneously for efficient and productive operations. For example, the operator must control the boom 104, stick 106, and work implement 110 all at once for coordinated movement of the entire set of linkages. For a work machine 102 having an extendable stick 108, an additional linkage for control is added. Although a skilled operator can operate all the controls somewhat successfully, it is still a very difficult task and productivity must of necessity suffer somewhat. The present invention is designed to combine and coordinate the control of the stick 106 and the extendable stick 108 into one uniform motion so that a degree of complexity of operator control is eliminated.

Other aspects, objects, and features of the present invention can be obtained from a study of the drawings, the disclosure, and the appended claims.

What is claimed is:

1. A method for automatically controlling the movement of an extendable stick on a work machine, the extendable stick being slidably connected to a stick, the stick being pivotally connected to a boom, including the steps of:

determining a position of the stick relative to the boom;

determining a position of the extendable stick relative to the stick;

receiving a stick movement command to move the stick relative to the boom;

moving the stick relative to the boom; and automatically moving the extendable stick in coordination with the movement of the stick as a predetermined function of a desired position of the extendable stick relative to the position of the stick.

2. A method, as set forth in claim 1, wherein moving the extendable stick in coordination with the movement of the stick as a function of a desired position of the extendable stick relative to the position of the stick includes the step of moving the extendable stick in coordination with the movement of the stick as a function of a map of a desired position of the extendable stick relative to the position of the stick.

3. A method, as set forth in claim 1, wherein moving the extendable stick in coordination with the movement of the stick as a function of a desired position of the extendable stick relative to the position of the stick includes the step of moving the extendable stick in coordination with the movement of the stick as a function of an algorithm of a desired position of the extendable stick relative to the position of the stick.

4. A method, as set forth in claim 1, wherein determining a position of the stick relative to the boom includes the step of determining a displacement of a stick cylinder controllably attached to the stick.

5. A method, as set forth in claim 1, wherein determining a position of the extendable stick relative to the stick includes the step of determining a displacement of an extendable stick cylinder controllably attached to the extendable stick.

6. A method, as set forth in claim 1, wherein determining a position of the stick relative to the boom, and determining a position of the extendable stick relative to the stick includes the steps of:

determining a displacement of a stick cylinder controllably attached to the stick; and determining a displacement of an extendable stick cylinder controllably attached to the extendable stick.

7. A method, as set forth in claim 6, wherein moving the extendable stick in coordination with the movement of the stick includes the step of moving the extendable stick in coordination with the stick as a function of a map of a desired displacement of the extendable stick cylinder relative to the displacement of the stick cylinder.

8. A method, as set forth in claim 6, wherein moving the extendable stick in coordination with the movement of the stick includes the step of moving the extendable stick in coordination with the stick as a function of an algorithm of a desired displacement of the extendable stick cylinder relative to the displacement of the stick cylinder.

9. An apparatus for automatically controlling the movement of an extendable stick on a work machine, the extendable stick being slidably connected to a stick, the stick being pivotally connected to a boom, comprising:

means for determining a position of the stick relative to the boom;

means for determining a position of the extendable stick relative to the stick; means for receiving a stick movement command to move the stick relative to the boom;

means for moving the stick relative to the boom; and means for automatically moving the extendable stick in coordination with the movement of the stick as a predetermined function of a desired position of the extendable stick relative to the position of the stick.

10. An apparatus, as set forth in claim 9, wherein the means for determining a position of the stick relative to the boom includes means for determining a displacement of a stick cylinder controllably attached to the stick.

11. An apparatus, as set forth in claim 10, wherein the means for moving the extendable stick in coordination with the movement of the stick includes means for moving the extendable stick in coordination with the stick as a function of a map of a desired displacement of the extendable stick cylinder relative to the displacement of the stick cylinder.

12. An apparatus, as set forth in claim 10, wherein the means for moving the extendable stick in coordination with the movement of the stick includes means for moving the extendable stick in coordination with the stick as a function of an algorithm of a desired displacement of the extendable stick cylinder relative to the displacement of the stick cylinder.

13. An apparatus, as set forth in claim 9, wherein the means for determining a position of the extendable stick relative to the stick includes means for determining a displacement of an extendable stick cylinder controllably attached to the extendable stick.

14. An apparatus, as set forth in claim 9, wherein the means for determining a position of the stick relative to the boom, and the means for determining a position of the extendable stick relative to the stick includes:

means for determining a displacement of a stick cylinder controllably attached to the stick; and means for determining a displacement of an extendable stick cylinder controllably attached to the extendable stick.

15. An apparatus for automatically controlling the movement of an extendable stick on a work machine, the extendable stick being slidably connected to a stick, the stick being pivotally connected to a boom, comprising:

a first sensor for determining a position of the stick relative to the boom;

a second sensor for determining a position of the extendable stick relative to the stick; and a controller for receiving a stick movement command to move the stick relative to the boom, for moving the stick, and for automatically moving the extendable stick in coordination with the movement of the stick as a predetermined function of a desired position of the extendable stick relative to the position of the stick.

16. An apparatus, as set forth in claim 15, further including:

a stick cylinder controllably attached to the stick; and an extendable stick cylinder controllably attached to the extendable stick.

17. An apparatus, as set forth in claim 16, wherein:

the first sensor is adapted for sensing a displacement of the stick cylinder; and the second sensor is adapted for sensing a displacement of the extendable stick cylinder.

18. An apparatus, as set forth in claim 17, wherein the controller is further adapted for moving the extendable stick in coordination with the stick as a function of a map of a desired displacement of the extendable stick cylinder relative to the displacement of the stick cylinder.

19. An apparatus, as set forth in claim 17, wherein the controller is further adapted for moving the extendable stick in coordination with the stick as a function of an algorithm of a desired displacement of the extendable stick cylinder relative to the displacement of the stick cylinder.

20. A method for controlling the movement of an extendable stick on a work machine, the extendable stick being slidably connected to a stick, the stick being pivotally connected to a boom, including the steps of:

selecting one of a manual control mode and a coordinated control mode;

operating each of a stick control device and an extendable stick control device to control the respective movement of each of the stick and the extendable stick in response to selecting the manual control mode; and operating only the stick control device to control the movement of the stick and the extendable stick in response to selecting the coordinated control mode, the movement of the extendable stick being made in coordination with the movement of the stick as a function of a desired position of the extendable stick relative to the position of the stick.

21. A method, as set forth in claim 20, wherein operating in the coordinated control mode includes the steps of:

determining a position of the stick relative to the boom;

determining a position of the extendable stick relative to the stick;

receiving a stick movement command to move the stick relative to the boom;

moving the stick relative to the boom; and moving the extendable stick in coordination with the movement of the stick as a function of a desired position of the extendable stick relative to the position of the stick.

22. A method, as set forth in claim 21, wherein determining a position of the stick relative to the boom, and determining a position of the extendable stick relative to the stick includes the steps of:

determining a displacement of a stick cylinder controllably attached to the stick; and determining a displacement of an extendable stick cylinder controllably attached to the extendable stick.

23. A method, as set forth in claim 22, wherein moving the extendable stick in coordination with the movement of the stick includes the step of moving the extendable stick in coordination with the stick as a function of a map of a desired displacement of the extendable stick cylinder relative to the displacement of the stick cylinder.

24. A method, as set forth in claim 22, wherein moving the extendable stick in coordination with the movement of the stick includes the step of moving the extendable stick in coordination with the stick as a function of an algorithm of a desired displacement of the extendable stick cylinder relative to the displacement of the stick cylinder.

25. A work machine, comprising:

a boom;

a stick having a first end pivotally connected to the boom;

an extendable stick having a first end slidably connected to a second end of the stick;

a work implement controllably attached to a second end of the extendable stick;

a first sensor for determining a position of the stick relative to the boom;

a second sensor for determining a position of the extendable stick relative to the stick;

a stick control device for delivering a stick movement command; and a controller for receiving the stick movement command and responsively moving the stick relative to the boom, and for automatically moving the extendable stick in coordination with the movement of the stick as a predetermined function of a desired position of the extendable stick relative to the position of the stick.

26. A work machine, as set forth in claim 25, further including:

a stick cylinder attached to the stick for controlling the movement of the stick relative to the boom; and an extendable stick cylinder attached to the extendable stick for controlling the movement of the extendable stick relative to the stick.

* * * * *